United States Patent [19]

Fukae

[11] Patent Number: 5,048,983

[45] Date of Patent: Sep. 17, 1991

[54] ELECTROGRAPHIC TYPEWRITER

[75] Inventor: Kensuke Fukae, Monsey, N.Y.

[73] Assignee: Kentek Information Systems, Inc., Allendale, N.J.

[21] Appl. No.: 358,695

[22] Filed: May 26, 1989

[51] Int. Cl.[5] ..... B41J 2/45

[52] U.S. Cl. ..... 400/119; 355/220

[58] Field of Search ..... 400/119; 355/251, 220

[56] References Cited

U.S. PATENT DOCUMENTS

| | | | |
|---|---|---|---|
| 4,194,833 | 3/1980 | Lester et al. | 355/67 |
| 4,300,475 | 11/1981 | Bond | 355/251 |
| 4,660,059 | 6/1987 | O'Brien | 400/119 |
| 4,685,702 | 8/1987 | Kazuharu . | |
| 4,714,940 | 12/1987 | Inoue et al. . | |
| 4,789,259 | 12/1988 | Katayanagi | 400/624 |
| 4,818,131 | 4/1989 | Sakai | 400/63 |
| 4,841,334 | 6/1989 | Fukae et al. | 355/271 |

FOREIGN PATENT DOCUMENTS

| | | | |
|---|---|---|---|
| 0091296 | 10/1983 | European Pat. Off. | 400/119 |

OTHER PUBLICATIONS

Jason Office Products Catalog, 1989, p. 446—Description of Smith-Corona Mod. PWP-80.

*Primary Examiner*—Edgar S. Burr
*Assistant Examiner*—Ren Yan
*Attorney, Agent, or Firm*—Marmorek, Guttman & Rubenstein

[57] ABSTRACT

An electrophotographic typewriter comprises a housing on which are mounted an alphanumeric keyboard, a flat-plane display unit, a paper feed tray and a paper output tray. A paper feed path is routed through an electrographic print unit, located in the housing, and comprises a photoconductive drum surrounded by a charging unit, an optical print head, a developing unit, a transfer unit, an erasing unit and a cleaning unit arranged in sequence about the photoconductive drum. An electronics package processes the alphanumeric input data to generate the flat-plane display and the outputs to the optical print head. Hard paper copy is produced where the paper feed path passes between the photoconductive drum and the transfer unit.

4 Claims, 2 Drawing Sheets

ELECTROGRAPHIC TYPEWRITER

FIELD OF THE INVENTION

The present invention relates to a typewriter-like device that incorporates electrographic printing means to produce hard copy.

BACKGROUND OF THE INVENTION

Originally, the typewriter was a wholly mechanical device comprising an alpha-numeric keyboard, mechanical linkages between the keys and individual slugs of type, an inked ribbon and a paper carriage. Striking a key caused the corresponding typeface to impact on the inked ribbon located on the paper thereby printing the symbol on the typeface. The paper carriage was then moved one space, the process was repeated and the next symbol was printed. At the end of the line the carriage was returned, the paper was advanced one line and the process repeated to print the next line.

A major advance in typewriter technology was the development of the type ball and the daisy wheel. These did away with the individual mechanical linkage of one key to one corresponding typeface. Instead, the stroke of a key caused proper electromechanical positioning of the type ball or the daisy wheel so that the correct symbol was imprinted. These developments also did away with the cumbersome paper carriage moving from side to side. What remained, was a paper carriage which functioned to advance the paper one line at a time and the ink ribbon interposed between the paper and type ball or daisy wheel. Printing of the symbols on the paper was still by means of impact of the typeface on the ribbon and paper.

The advent of miniaturized electronics, microprocessors and sophisticated computer and display technology brought significant improvements to the input side of the typewriter, which acquired some of the attributes of a word processor. In a typical electronic typewriter such as the Smith-Corona PWP-80, as many as sixteen lines could be entered (typed), viewed on a flat panel display and edited prior to printing on the paper.

However, the method of actually committing data to paper remained in many instances the same: impact of a typeface on an inked ribbon laid on a sheet of paper. What also remained basically the same was the impact noise, vibration, the need frequently to change typewriter ribbons, and wear and tear on the typefaces.

In another kind of electronic typewriter, the data was printed thermally on paper. This involved the use of a dot matrix-like thermal print head which burned the data directly onto special thermal paper, or the use of a special thermal transfer ribbon interposed between the thermal print head and ordinary paper. In either case, the quality of the print was low and the use of specialized supplies was undesirable.

It is the object of this invention to eliminate the undesirable aspects of the prior art electronic typewriters. Thus, it is an object of the present invention to eliminate the mechanical output side of electronic typewriters which use a type ball or daisy wheel thereby doing away with the impact noise, vibration, wear on typefaces and the need to change ribbons. It is also an object of the present invention to eliminate the thermal print head and thermal transfer ribbon in electronic typewriters which print thermally.

This is accomplished, in this invention, by incorporating an electrophotographic or xerographic print unit in the typewriter housing in place of the mechanical or thermal print units previously used.

Related prior art includes devices in which electrophotographic image processors, i.e., xerographic printers, are connected as secondary output devices to word processors or computers. One such device is described in U.S. Pat. No. 4,714,940, Inoue et al, in which a copier is used to simultaneously or selectively copy an image displayed on a display screen and an image on an original. There the primary output device of the word processor is the display screen and the copier can copy the display. However this device and other prior art devices which rely on xerographic printers or copiers bear no relationship to a typewriter in form or in function.

It is an object of this invention to provide a typewriter in which the printing is accomplished by electrophotographic means rather than by mechanical or thermal means.

It is an object of this invention to eliminate printing impact noise and vibration.

It is also an object of this invention to provide a typewriter which does not require typewriter ribbons thereby eliminating any requirement for periodic replacement of ribbon cartridges.

SUMMARY OF THE INVENTION

An electrophotographic typewriter, in accordance with this invention, achieves these objects by incorporating an electrophotographic apparatus. Thus the typewriter of the present invention comprises a housing, an input paper tray and an output paper tray attached to the housing and a paper feed path, connecting the two trays, going through the housing. The housing also contains an electrophotographic printing apparatus comprising a photoconductive drum about which the following units are arranged in sequence: a charging unit for uniformly charging the photoconductive drum, an optical print head for discharging selected portions of the photoconductive drum so as to form a latent electrostatic image thereon, a developer unit for developing the electrostatic latent image, a transfer unit for transferring the developed electrostatic image to the paper in the paper feed path, a cleaning unit (optional) for removing residual developer particles from the photoconductive drum and an erasing lamp for uniformly discharging the photoconductive drum to prepare it for the next cycle.

The paper feed slot is so located within the housing as to guide the paper first between the photoconductive drum and the charge transfer roller, and then through the fuser prior to exiting via exit rollers to the output paper tray. An alphanumeric keyboard and a flat panel display (e.g. LCD) are mounted on the front portion of the housing.

Contained within the housing is the electronics circuitry for processing the keyboard inputs to produce the output display on the flat panel and to provide the appropriate data inputs to the optical print head. The electronics circuitry comprises an image generating system (IGS) controller card, and a bit map controller.

In short, what is achieved by the present invention is a device which appears to the user to be typewriter-like, but which has the advantages of electrophotographic printing.

DETAILED DESCRIPTION OF THE DRAWINGS

Figure 1:
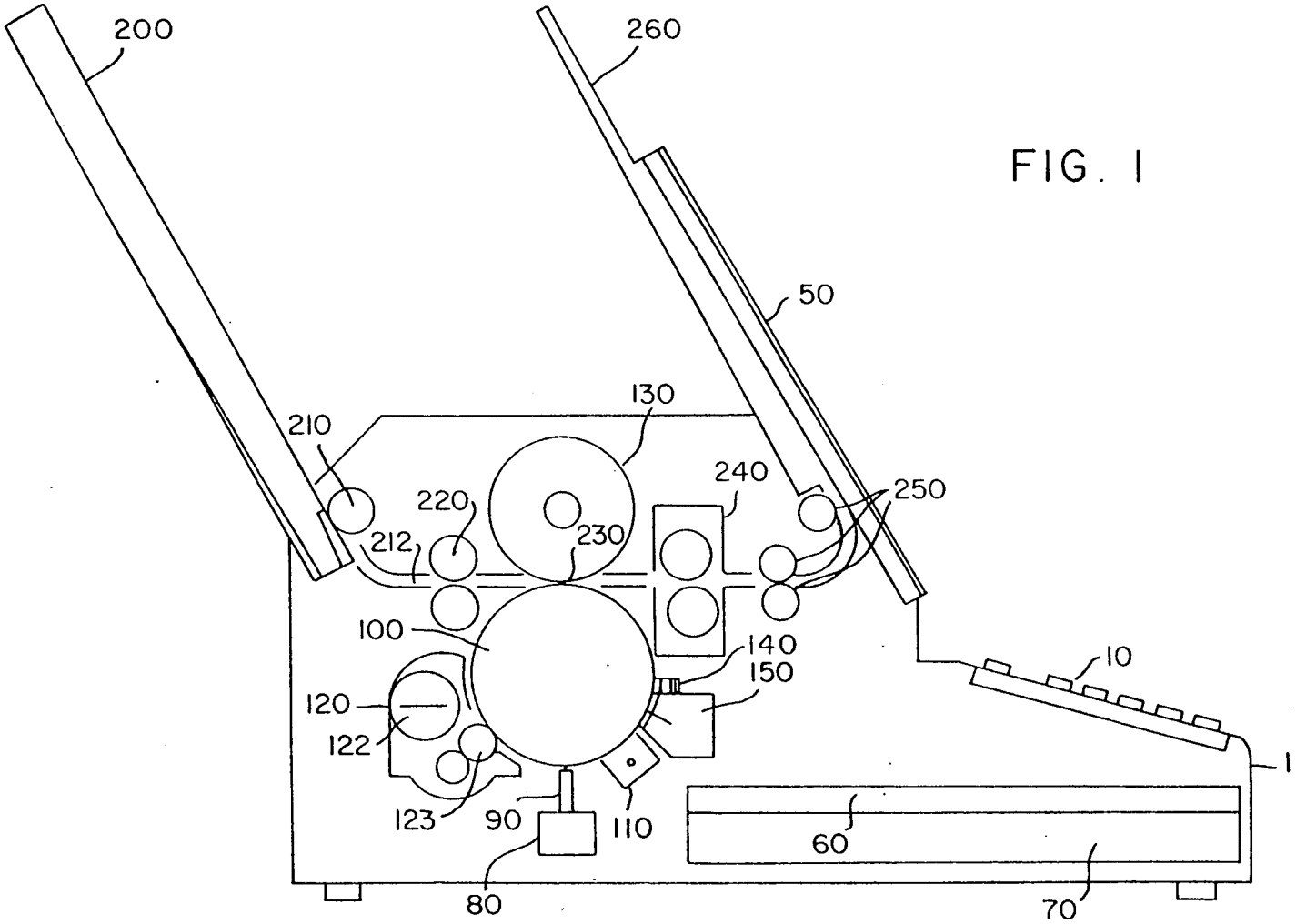
FIG. 1 is a schematic diagram of an electrophotographic typewriter in accordance with the present invention.

FIG. 1 is a block diagram illustrating the main components of an electrophotographic typewriter in accordance with a preferred embodiment of the present invention. These components can be grouped under three categories: the keyboard, display and electronics groups; the paper input, feed path and paper output group; and the electrophotographic printing group.

A housing 1 is configured to contain these three component groups. Appropriate openings (not shown) in the sides and top of the housing 1 provide access for maintenance and repair. An alphanumeric word processor type keyboard 10 is mounted on the front panel of the housing 1. A flat panel liquid crystal display 50, with a 16-line by 80-character capacity is mounted on the housing above the keyboard, optimally located for ease of reading. The electronic units are located within the housing 1 and comprise a bit map controller 60 and an IGS (Image Generating System) Controller Card 70. Optionally, a disk drive may also be built into housing 1.

The bit map controller 60 and the IGS controller 70 provide the data input for the electrographic printing group via LED array 80 and self-focussing lens array 90 which images the LED array 80 onto photoconductive drum 100. The components of the electrographic printing group are a small diameter (approximately 20 mm to 60 mm) photoconductive drum 100, around which are arranged in sequence a charger 110, LED array 80 and lens array 90, a developer unit 120, a charge transfer roller 130, an erase lamp 140 and (optionally) a cleaner 150.

The paper feed path 212 interfaces with the electrophotographic printing group at the transfer region 230 where a sheet of recording medium passes between the photoconductive drum 100 and the charge transfer roller 130. The paper feed system starts with the paper tray 200 mounted on the housing 1. Paper or another suitable recording medium stacked in the tray is fed into the paper path 212 by means of paper feed roller 210 and is propelled along by timing rollers 220. The paper passes between the photoconductive drum 100 and the charge transfer roller 130, where the developed electrostatic image is transferred onto the paper from the drum 100. The paper is then propelled through fuser 240 which fixes the image on the paper. Exit rollers 250 then cause the paper sheet to be deposited in paper output holder 260 which is mounted on housing 1 as illustrated.

In a preferred embodiment of this invention, when a user first turns on the equipment, the flat-screen display 50 presents an image of a blank page, with margins and top and bottom spacing shown in dashed outline.

If the user wishes to change the page format from the default settings, he strikes a "Page Format" key, preferably a labelled function key. This causes the display to change from a blank page to a page formatting menu, with instructions on how to change the default format values. The menu also indicates the default font, pitch and line spacing settings and whether the text will be right-margin justified or ragged, along with directions for changing the settings.

When the user has made the desired changes, he again strikes the "Page Format"key to enter the new values, and bring up a blank page on the display. He now creates a page of text by typing on the keyboard 10 and viewing the resultant text on the flat-panel display 50.

When the user is typing to an initially blank screen, the equipment is automatically set to operate in "Insert" mode, the typed-in characters being inserted into the blank spaces of the display.

When the user is satisfied with the content and format of a page of text, he strikes a "Print" key. This transfers the page content to the equipment's image generation system 70, that converts the ASCII code representation of blank spaces and characters into a bit map memory associated with the bit map controller 60. The image generation system 70 then scans out the bit map, a line-slice at a time, so that successive slices will stack to form high resolution characters. The bit map output is used to modulate a dense line array 80 of very small LEDs that serve as light sources to form a latent image on a pre-charged photoconductive roller 100 a line-slice at a time.

The latent image thus formed is developed at an adjacent developer unit 120, where precharged magnetic toner particles, adhering to a magnetic brush roller, are electrostatically attracted only to the partially discharged area that comprise the latent image. The toner particles leave the magnetic brush and adhere to the photoconductive roller only at those latent image areas, thus forming a developed image. The photoconductive roller now rotates to an adjacent transfer region 230, where a sheet of paper in contact with the oppositely charged paper feed/charge transfer roller 130, attracts the toner particles. The transfer roller 130 is maintained at a charge of about +25V. This voltage is applied to the sheet of paper when it enters transfer region 230. This voltage causes about 80 to 90% of the negatively charged toner particles to transfer from the photoconductive drum 100 to the sheet of paper. The drum 100 continues to rotate and it is erased by erase lamp 140 and cleaned of residual toner 150 which may, for example, contain an elastic doctor blade. It is also possible to fine tune the charge on transfer roller 130 to the characteristics, such as the moisture content, of the paper. With such fine tuning of the charge on transfer roller 130 it is possible to achieve 90% or more transfer of the toner particles to the sheet of paper, in which case cleaner unit 150 becomes unnecessary.

After transfer, the sheet of paper moves to an immediately adjacent fuser unit 240, that fuses the toner particles so they bond to the paper. The paper feed timing rollers 220 continuously step the sheet of paper along, as freshly created developed images become available for transfer to the sheet of paper. Finally, when the entire page has been printed, other feed rollers 250 deliver the printed sheet, face side up, to an output tray 260 behind and above the flat-screen display 50.

Figure 2:
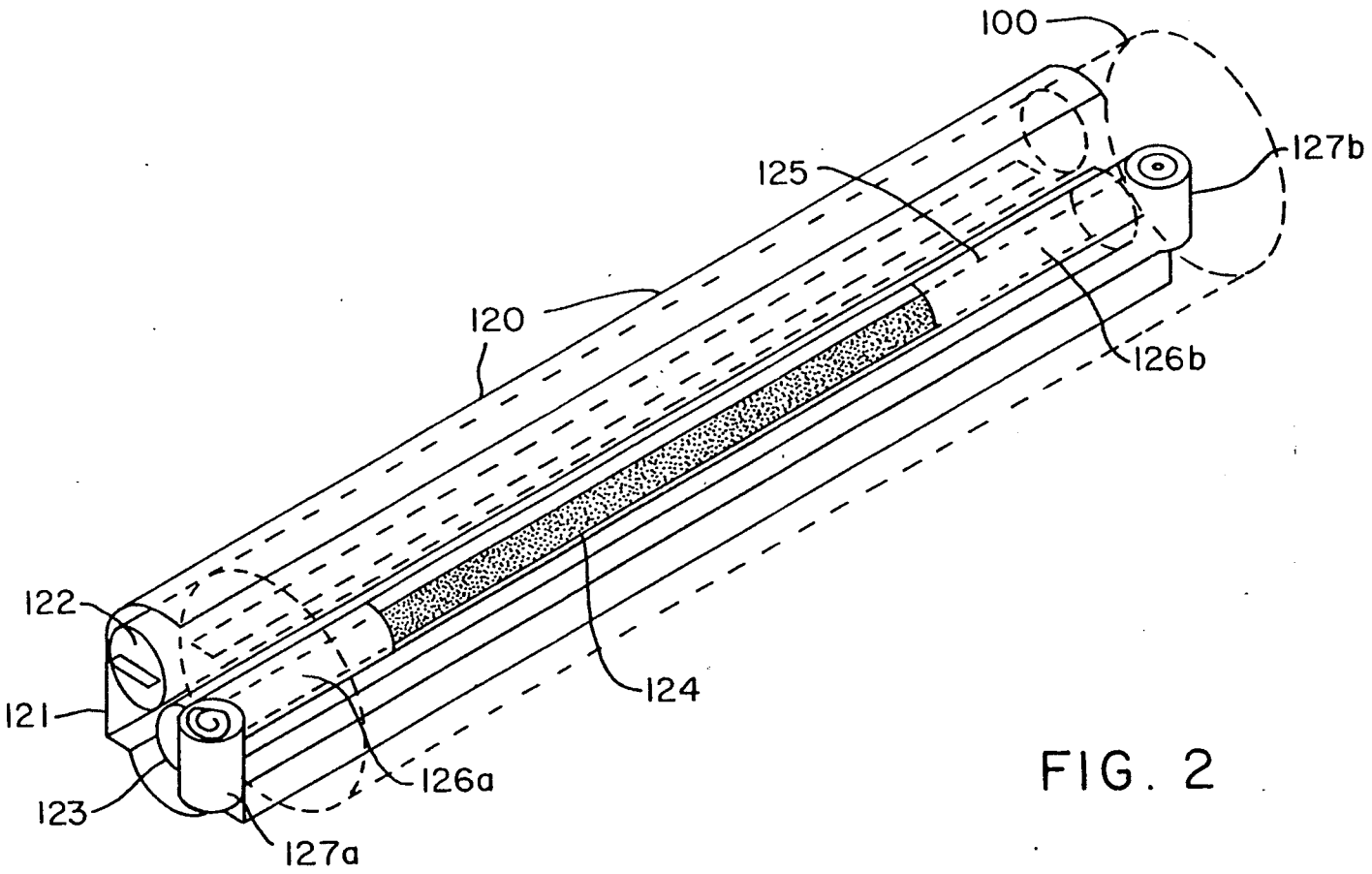
FIG. 2 is a schematic diagram of the developer unit equipped with an adjustable mechanical shutter.

FIG. 2 illustrates several unusual features of developer unit 120.

The developer unit 120 comprises a housing 121 into which a toner cartridge 122 can be easily inserted most conveniently through a removable access plate (not shown) on the side of the housing 1. Cartridges 122 are formed with a length of tape sealing (not shown) over the toner release slot (not shown). The tape sealing is removed when the toner cartridge is used. After the toner cartridge is inserted and rotated so that this slot, initially facing up, is made to face down, toner particles will sift down through the slot into the curved bottom of the housing 121 that serves as a toner well whence they will be picked up by magnetic roller brush 123. These particles are magnetic and will adhere to the surface of the magnetic roller brush 123 until they are stripped off by a force stronger than the magnetic attraction. That stronger force will be the electrostatic attraction between the toner particles at a potential of approximately −300V and the exposed portions of the photoconductor, where exposure to the LED array has formed latent images at approximately −100V, far above the −550V potential of the corona-charged surface of the photoconductor drum that has not been partially discharged by exposure to LED illumination.

Developer unit 120 is so named because it supplies the means and the toner material for developing, by electrostatic attraction of toner onto the surface of the photoconductor drum, the latent image created by the image-forming exposure of the LED array.

A noteworthy feature of the developer unit 120 is the adjustable mechanical shutter 125. It is implemented by means of a pair of mylar sleeves 126*a* and 126*b* which encase both ends of magnetic roller brush 123. The extent of encasement can be adjusted by means of mylar sleeve take-up rolls 127*a* and 127*b*. This shutter, when moved into its masking position, masks off each end of the magnetic roller surface 124, from its original width of 11 inches to a masked-off width of 8.5 inches. Toner particles on the masked-off portion of the magnetic roller cannot reach the photoconductor drum 100, which is, by this means, adaptable to develop on its surface, images of up to either 11 inches or 8.5 inches in width, matching those two standard dimensions of paper, and permitting standard size sheets to be inserted sideways, for expanded format printing.

The photoconductor drum 100 is seamless so that it can be used continuously. There is no need for any wasted rotation in order to avoid forming a latent image across a seam. Drum 100 is also remarkable for its small diameter, on the order of between 20 mm and 60 mm. As is apparent from FIG. 1, an image is contained only on that portion of the drum's surface between the magnetic roller brush 123 of developer unit 120, where the latent image is developed, and transfer region 230 where that image is transferred to paper preparatory to its fuse-bonding to the paper by fuser 240.

The peripheral length of that portion of drum 100 between the magnetic roller brush 123 and the transfer region 230 may be as small as an inch or so. Clearly, if some reasonable rate of page throughput is to be achieved, the drum 100 will have to rotate briskly. This has a significant impact on the achievement of printout quality.

To understand this, it is important to be aware of the fact that a major factor heretofore limiting the choice of photoconductor material has been a photoconductor's rate of dark decay. The dark decay rate is the rate of self-discharge of a given photoconductive material in the absence of discharging illumination—hence the appellation "dark decay."

In current electrographic printers (and copiers) at least one-half page of text (and/or graphics) is developed on a photoconductor surface before image transfer is effected. In addition, such equipments have a fairly long path length between the photoconductor's corona charger and the developed unit. Thus a relatively long interval elapses between the time that a point on the photoconductor gets charged, the time that any latent image on that point gets developed, and the time that the developed image is transferred from the photoconductor to paper. Therefore, to prevent deterioration of image quality such equipments generally employ photoconductive material with low rates of dark decay. Since a low rate of dark decay is commonly associated with low photoconductor sensitivity, a host of serious design compromises typically ensue, involving light source intensity and exposure interval among other factors.

As can be seen in FIG. 1, the path length between charger 110 and developer roller brush 123 may be on the order of from one to two inches, and the same is true of the path length from the developer roller brush 123 to the transfer region 230. Therefore, these short path lengths in combination with the continuous brisk rotation of photoconductor drum 110 virtually eliminate dark decay as a concern, enabling use of more sensitive photoconductive materials whose relatively rapid dark decay will pose no problem for this printer.

Suitable changes can be made to the configuration described herein, to produce a more compact and portable device. The paper input and output trays and the flat panel display can be pivoted or hinged to the housing to enable them to fold into the housing envelope, when the electrographic typewriter is not in use. Alternatively, the paper trays and display panel may be made removable for ease of storage and for portability.

The invention has been described by reference to a specific embodiment. However, this is for purposes of illustration only and should not be construed to limit the spirit or scope of the invention.

I claim:

1. An electrographic typewriter for electrophotographically printing information on a recording medium, comprising:

a) a housing;

b) an alphanumeric keyboard mounted on said housing;

c) a flat-plane display mounted on said housing;

d) a rotatable photoconductive drum mounted in said housing;

e) a charging unit, a selective discharging unit, a developing unit, a transfer unit, and an erasing unit arranged in sequence around said photoconductive drum in said housing;

f) a paper feed system comprising an input paper tray mounted on said housing, feeding into a paper feed path located in said housing and passing between said photoconductive drum and said transfer unit, said feed path continuing through a fuser unit mounted in said housing, said feed path terminating in an output tray mounted on said housing, and g) electronic processing means in said housing for processing input data from said alphanumeric keyboard, and for generating output data for said flat-plane display and for said selective discharging unit, said selective discharging unit comprising illumination means for illuminating said photoconductive drum with a light signal to be developed by said developing unit, said electronic processing means including means for converting said input data from said alphanumeric keyboard directly into said light signal illuminated on said photoconductive drum, whereby in a single housing, data entered into said alphanumeric keyboard is displayed on said flat-plane display, and is converted into an image on said rotatable photoconductive drum, said image being transferred to paper in said feed path by said transfer unit.

2. The electrographic typewriter, as recited in claim 1, wherein said selective discharging unit comprises a LED array and a self-focussing lens array.

3. The electrophotographic typewriter, as recited in claim 1, wherein said electronic processing mans comprise a bit map controller and an Image Generating System (IGS) card.

4. The electrographic typewriter, as recited in claim 1, wherein said transfer unit comprises a charge transfer roller, said charge transfer roller further comprising a paper transport roller.

* * * * *